US006766935B2

(12) United States Patent
Pedicini et al.

(10) Patent No.: US 6,766,935 B2
(45) Date of Patent: Jul. 27, 2004

(54) MODIFIED ELECTRICAL MOTOR DRIVEN NAIL GUN

(75) Inventors: Christopher S. Pedicini, Roswell, GA (US); John D. Witzigreuter, Kennesaw, GA (US)

(73) Assignee: Tricord Solutions, Inc., Roswell, GA (US)

( * ) Notice: Subject to any disclaimer, the term of this patent is extended or adjusted under 35 U.S.C. 154(b) by 0 days.

(21) Appl. No.: 10/426,149

(22) Filed: Apr. 29, 2003

(65) Prior Publication Data

US 2003/0192933 A1 Oct. 16, 2003

Related U.S. Application Data

(63) Continuation of application No. 10/091,410, filed on Mar. 7, 2002, now Pat. No. 6,604,666.
(60) Provisional application No. 60/313,618, filed on Aug. 20, 2001.

(51) Int. Cl.[7] ..... B25C 1/06
(52) U.S. Cl. ..... 227/131; 227/2; 227/120; 227/132; 173/124; 173/205
(58) Field of Search ..... 227/131, 2, 120, 227/132, 134, 129; 173/124, 205

(56) References Cited

U.S. PATENT DOCUMENTS

| | | | | |
|---|---|---|---|---|
| 1,823,644 A | | 9/1931 | Cossock | |
| 3,589,588 A | | 6/1971 | Yasku | |
| 3,810,572 A | | 5/1974 | Malkin | |
| 4,005,812 A | | 2/1977 | Doyle et al. | |
| 4,121,745 A | | 10/1978 | Smith et al. | |
| 4,204,622 A | | 5/1980 | Smith | |
| 4,298,072 A | | 11/1981 | Baker et al. | |
| 4,530,454 A | * | 7/1985 | Gloor et al. | 227/129 |
| 4,583,600 A | | 4/1986 | Smith, III | |
| 4,640,452 A | * | 2/1987 | Matt et al. | 227/131 |
| 4,928,868 A | | 5/1990 | Kerrigan | |
| 4,953,774 A | * | 9/1990 | Lai | 227/131 |
| 4,964,558 A | | 10/1990 | Crutcher | |
| 5,098,004 A | * | 3/1992 | Kerrigan | 227/134 |
| 5,320,270 A | | 6/1994 | Crutcher | |
| 5,495,161 A | * | 2/1996 | Hunter | 318/807 |
| 5,511,715 A | | 4/1996 | Crutcher | |
| 5,927,585 A | | 7/1999 | Moorman et al. | |
| 6,604,666 B1 | * | 8/2003 | Pedicini et al. | 227/131 |

FOREIGN PATENT DOCUMENTS

| | | |
|---|---|---|
| GB | 2000716 | 1/1979 |

* cited by examiner

*Primary Examiner*—Scott A. Smith
(74) *Attorney, Agent, or Firm*—Moore Ingram Johnson & Steele, LLP; Jonathan H. Peteu, Esq.

(57) ABSTRACT

A portable electric nailing gun operating from a power source. The motor accelerates a flywheel which at the appropriate energy state is coupled through a mechanism to an anvil acting directly on the nail. The motor accelerates a flywheel that is then clutched to the output anvil causing the nail to be driven. The position of the output anvil is sensed and once the nail is driven, the motor is dynamically braked reducing the excess energy in the flywheel. This method uses a highly responsive motor and power source which enables the motor to come up to speed, drive the nail and return to a low energy condition in less than 2 seconds. The electrical control circuit and brake allow precise control and improve safety. The power source is preferably a rechargeable low impedance battery.

25 Claims, 6 Drawing Sheets

MODIFIED ELECTRICAL MOTOR DRIVEN NAIL GUN

CROSS-REFERENCE TO RELATED APPLICATIONS

This utility application is the nonprovisional Continuation application of nonprovisional application Ser. No. 10/091,410, filed on Mar. 7, 2002, now U.S. Pat. No. 6,604,666, which was the nonprovisional application of Provisional Application No. 60/313,618, filed on Aug. 20, 2001.

STATEMENT REGARDING FEDERALLY SPONSORED RESEARCH OR DEVELOPMENT

Not Applicable

REFERENCE TO SEQUENCE LISTING, A TABLE, OR A COMPUTER LISTING COMPACT DISK APPENDIX

Not Applicable

BACKGROUND OF INVENTION

This application is a continuation of utility application Ser. No. 10/091,410 and all parts of the parent application are incorporated herein by this specific reference.

This invention relates to fastening mechanisms, specifically to such nail or staple fastening mechanisms that require operation as a hand tool. This invention relates generally to an electromechanical fastener driving tool. Such devices are less than 15 pounds and are completely suitable for an entirely portable operation.

Contractors and homeowners commonly use power-assisted means of driving fasteners into wood. These can be either in the form of finishing nail systems used in baseboards or crown molding in house and household projects, or in the form of common nail systems that are used to make walls or hang sheathing onto same. These systems can be portable (not connected or tethered to an air compressor or wall outlet) or non-portable.

The most common fastening system uses a source of compressed air to actuate a cylinder to push a nail into the receiving members. For applications in which portability is not required, this is a very functional system and allows rapid delivery of nails for quick assembly. It does however require that the user purchase an air compressor and associated air-lines in order to use this system.

Thereafter, inventors have created several types of portable nail guns operating off of fuel cells. Typically these guns have a cylinder in which a fuel is introduced along with oxygen from the air. The subsequent mixture is ignited with the resulting expansion of gases pushing the cylinder and thus driving the nail into the work pieces. Typical within this design is the need for a fairly complicated assembly. Both electricity and fuel are required as the spark source derives its energy typically from batteries. In addition, it requires the chambering of an explosive mixture of fuel and the use of consumable fuel cartridges. Systems such as these are already in existence and are sold commercially to contractors under the Paslode name.

There are other nail guns that are available commercially, which operate using electrical energy. They are commonly found as electric staplers and electric brad tackers. The normal mode of operation for these devices is through the use of a solenoid that is driven off of a power cord that is plugged into a wall outlet. One of the drawbacks of these types of mechanisms is that the force provided by a solenoid is governed by the number of ampere-turns in the solenoid. In order to obtain the high forces required for driving brads and staples into the work piece, a larger number of turns are required in addition to high current pulses. These requirements are counterproductive as the resistance of the coil increases in direct proportion to the length of the wire in the solenoid windings. The increased resistance necessitates an increase in the operational voltage in order to keep the amps thru the windings at a high level and thus the ampere-turns at a sufficiently large level to obtain the high forces needed to drive the nail. This type of design suffers from a second drawback in that the force in a solenoid varies in relation to the distance of the solenoid core from the center of the windings. This limits most solenoid driven mechanisms to short stroke small load applications such as paper staplers or small brad tackers.

The prior art teaches three additional ways of driving a nail or staple. The first technique is based on a multiple impact design. In this design, a motor or other power source is connected to the impact anvil thru either a lost motion coupling or other. This allows the power source to make multiple impacts on the nail thus driving it into the work piece. There are several disadvantages in this design that include increased operator fatigue since the actuation technique is a series of blows rather than a continuous drive motion. A further disadvantage is that this technique requires the use of an energy absorbing mechanism once the nail is seated. This is needed to prevent the heavy anvil from causing excessive damage to the substrate. Additionally, the multiple impact designs normally require a very heavy mechanism to insure that the driver does not move during the driving operation.

A second design that is taught includes the use of potential energy storage mechanisms in the form of a spring. In these designs, the spring is cocked (or activated) through an electric motor. Once the spring is sufficiently compressed, the energy is released from the spring into the anvil (or nail driving piece) thus pushing the nail into the substrate. Several drawbacks exist to this design. These include the need for a complex system of compressing and controlling the spring and the fact that the force delivery characteristics of a spring are not well suited for driving nails. As the nail is driven into the wood, more force is needed as the stroke increases. This is inherently backwards to a springs unloading scheme in which it delivers less force as it returns to its zero energy state.

A third means for driving a fastener that is taught includes the use of flywheels as energy storage means. The flywheels are used to launch a hammering anvil that impacts the nail. This design is described in detail in patent #4,042,036, #5,511,715 and #5,320,270. The major drawback to this design is the problem of coupling the flywheel to the driving anvil. This prior art teaches the use of a friction clutching mechanism that is both complicated, heavy and subject to wear. This design also suffers from difficulty in controlling the energy left over after the nail is driven. Operator fatigue is also a concern as significant precession forces are present with flywheels that rotate in a continuous manner. An additional method of using a flywheel to store energy to drive a fastener is detailed in British Patent #2,000,716. This patent teaches the use of a continuously rotating flywheel coupled to a toggle link mechanism to drive a fastener. This design is limited by the large precession forces incurred because of the continuously rotating flywheel and the complicated and unreliable nature of the toggle link mechanism.

All of the currently available devices suffer from a number of disadvantages that include:

1. Complexity of design. With the fuel driven mechanisms, portability is achieved but the design is inherently complicated. Mechanisms from the prior art that utilize rotating flywheels have enormously complicated coupling or clutching mechanisms. Devices that use springs as a potential energy storage device also have complicated spring compression mechanisms.
2. Noisy. The ignition of an explosive mixture to drive a nail causes a very loud sound and presents combustion fumes in the vicinity of the device. Multiple impact devices have a loud jack hammer type noise.
3. Complexity of operation. Combustion driven portable nail guns are more complicated to operate. They require consumables (fuel) that need to be replaced.
4. Use of consumables. Combustion driven portable nail gun designs use a fuel cell that dispenses a flammable mixture into the piston combustion area. The degree of control over the nail operation is very crude as you are trying to control the explosion of a combustible mixture.
5. Non-portability. Traditional nail guns are tethered to a fixed compressor and thus must maintain a separate supply line.
6. Using a spring as a potential energy storage device suffers from unoptimized drive characteristics. Additionally, the unused energy from the spring which is not used in driving the nail must be absorbed by the tool causing excessive wear.
7. The flywheel type storage devices suffer from significant precession forces as the flywheels are not intermittent and are left rotating at high speeds. This makes tool positioning difficult. The use of counter-rotating flywheels as a solution to this issue increases the complexity and weight of the tool.
8. Need for precise motor control for repeatable drives. Flywheel designs that throw an anvil must control flywheel speeds ±1% to ensure repeatable drives. This creates a need for highly complex and precise control over the motor.

BRIEF SUMMARY OF THE INVENTION

In accordance with the present invention, a fastening mechanism is described which derives its power from a low impedance electrical source, preferably rechargeable batteries, and uses a motor to directly drive a mechanism which pushes a fastener into a substrate. Upon receipt of an actuation signal from an electrical switch, an electronic circuit, which may be as simple as an on-off switch, connects a motor to the electrical power source. The motor is coupled to a kinetic energy storing mechanism, such as a flywheel, preferably through a speed reduction mechanism. Both the motor and the flywheel begin to spin. Within a prescribed amount of time, the flywheel is clutched to a fastener driving device that drives the anvil through an output stroke. The preferred fastener driving device is a slider crank mechanism. The clutching mechanism is preferably of a mechanical lockup design that allows for rapid and positive connection of the fastener driving device to the energy stored in the flywheel. A position indicating feedback device sends a signal to the electronics when the fastener driving device is at the bottom dead center of the stroke. The electronics processes this signal and disconnects the motor and begins to brake the flywheel. The preferred mode for the braking mechanism is to use dynamic braking from the motor followed by motor reversal if required to stop the flywheel within a prescribed distance. The clutching mechanism is preferably designed to allow significant variance in terms of the starting and stopping points to allow for a robust design. Once the brake is applied and the electronics completely reset, the fastening mechanism is ready for another cycle.

Accordingly, in addition to the objects and advantages of the portable electric nail gun as described above, several objects and advantages of the present invention are:

1. To provide a fastening means in which the operating element has an added degree of safety in which no combustible gases are present.
2. To provide a fastening means in which the operation is portable and is not tethered to either an electrical outlet or to an air compressor. This increases operator mobility since they do not have to worry about cords or air hoses.
3. To provide a fastening means in which the operation doesn't fatigue the operator due to excessive precessional forces or multiple hammer strokes during the driving operation.
4. To provide a fastening means in which the operation doesn't result in loud noises caused by combustion of explosive gases.
5. To provide a fastening means in which the control of the actual nail is possible electronically allowing greater safety means to be employed.
6. To provide a fastening system in which the source of energy is a rechargeable power supply thus eliminating the use of disposable fuel cell cartridges and decreasing the environmental impact.
7. To provide a fastening means in which the device is mechanically simpler to construct and simpler to operate.
8. To provide a fastening means in which a mechanical advantage is employed to increase the force on the nail as the nail depth into the substrate increases.
9. To provide a fastening means in which substantial precessional forces are only present during a short interval centered around the nail drive time.
10. To provide a fastening means in which the nail-driving anvil is positively returned to its rest position.
11. To provide a fastening means in which the kinetic energy storage mechanism (flywheel) is at a resting or near resting condition between cycles thus increasing the safety of the mechanism.

Further objects and advantages will become more apparent from a consideration of the ensuing description and drawings.

BRIEF DESCRIPTION OF THE SEVERAL VIEWS OF THE DRAWINGS

In the drawings, closely related figures have the same number but different alphabetic suffixes.

REFERENCE NUMBERS IN DRAWINGS

1 Power Source
2 Motor
3 Kinetic Energy Storing Mechanism (Flywheel)
4 Control Circuit Device
5 Switch
6 Crank Link
7 Fastener Driving Device (Anvil)
8 Fastener (Nail)
9 Crank Arm
10 Flywheel Pinion
11 Cam Gear Pinion
12 Cam Gear
13 Clutch Cam
14 Clutch Drive Pin
15 Clutch Drive Pin Return Spring
16 Drive Shaft
17 Drive Gears
18 Anvil Return Spring
19 Speed Pick up Sensor
20 Sensor Element
21 Motor Mount
22 Fastener-Driving Tool
23 Handle
24 Feeder Mechanism
25 Substrates
26 Nail Driving Mechanism
27 Anvil Guide
28 Safety Circuit
29 On Timer Delay Circuit
30 Power Switching Circuit
31 Off Timer Delay Circuit
32 Low Battery Indicator Circuit

DETAILED DESCRIPTION OF THE INVENTION

The operation of the invention in driving a nail into a substrate has significant improvements over that which has been described in the art. First, nails are loaded into a magazine structure. The nail gun is then placed against the substrates which are to be fastened and the trigger is actuated. The trigger allows a fastener driving device that uses energy stored in a flywheel to push the nail, or other fastener, into the substrate. The nail gun then returns to a rest position and waits for another signal from the user before driving another nail. These operations, from pulling the trigger to returning to a rest state constitute an intermittent cycle. The nail driving height can be set using an adjustable foot at the bottom end of the nail gun. Although only a simplified and a preferred embodiment are described, it is understood by those skilled in the art that alternate mechanisms for coupling the flywheel to the drive anvil can be used.

Simplified Embodiment of the Design

Figure 1B:
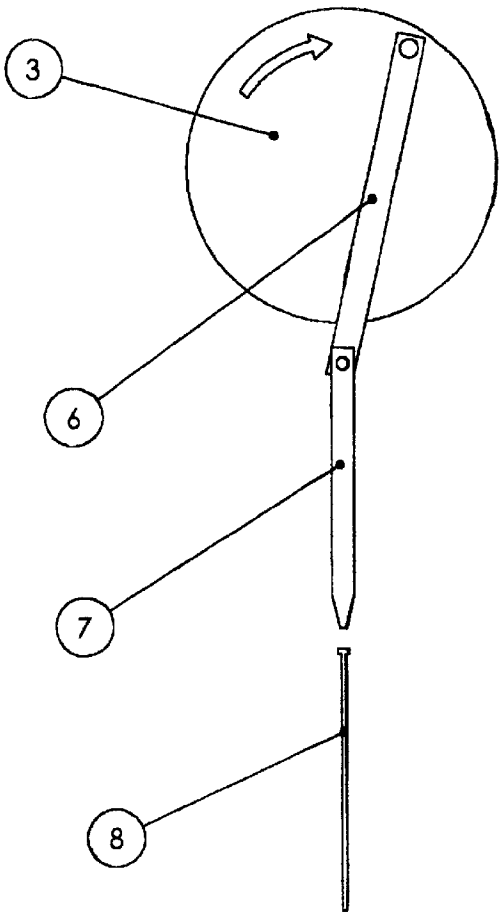
FIGS. 1*a* and 1*b* show various aspects of the nail fastening system in which the motor is coupled to a flywheel. The flywheel is coupled to the nail driving system.
Figure 1A:
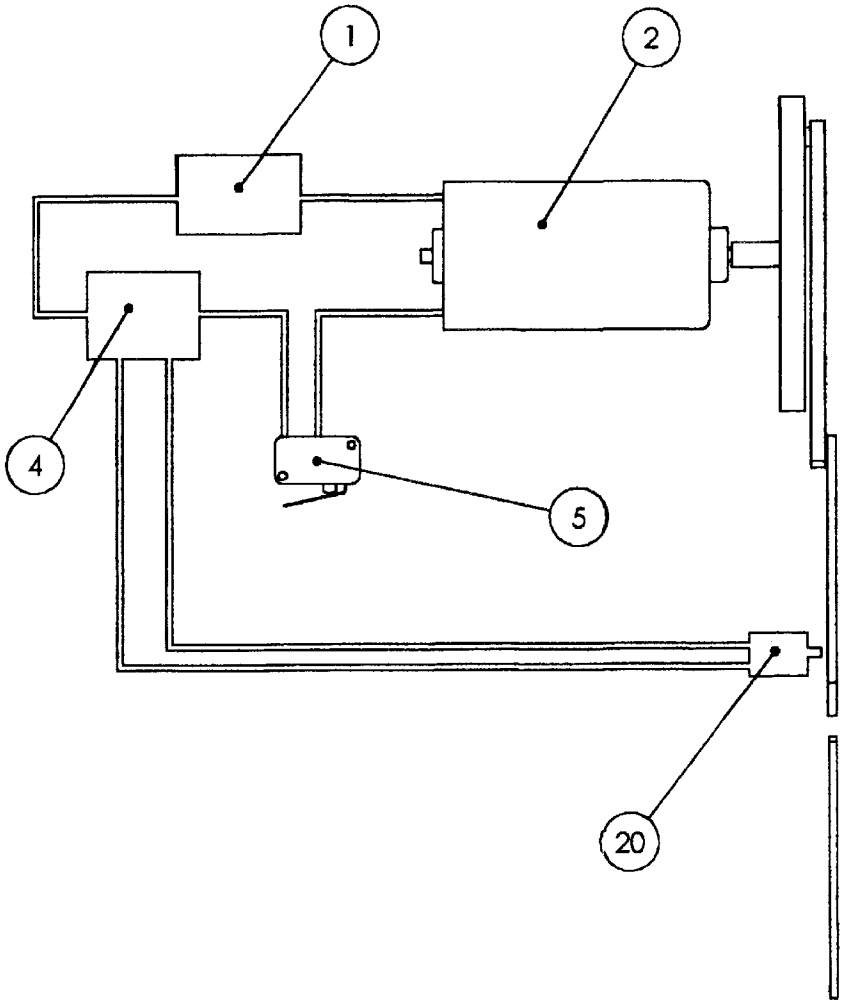

A simple embodiment that is good for small short nails is described. In the first embodiment shown in FIG. 1*a* and FIG. 1*b*, the control circuitry (4) and switch (5) apply power to the motor (2) from power source (1). The motor is directly coupled to the flywheel (3). The applied power causes the flywheel to accelerate for a certain portion of the flywheel rotation. In this embodiment, the acceleration distance of the flywheel before the anvil (7) impacts nail (8) is approximately 150 degrees. During the next 120 degrees of rotation the motor is continuing to apply power to the flywheel (3). The flywheel is directly coupled to a slider crank mechanism comprising the crank link (6) and the anvil (7). Once the slider crank has substantially hit bottom dead center (i.e. the nail is fully driven into the substrate), a sensor element (20) informs the control circuit (4) that the nail (8) has been completely driven into the substrate. The motor power is then removed and the motor windings are connected together through a low resistance connection (preferably less than 100 milli ohms) This dynamic braking rapidly slows down the motor (2) and flywheel (3) during the next 90 to 150 degrees. Once the motor (2) and flywheel (3) have come to a complete stop, the control circuit (4) assesses the position of the flywheel (3) and determines if any additional rotation is necessary in order to position the anvil (7) in preparation for the next nail. (8). It is clear in this design, that all the drive energy is stored into the flywheel within the first 150 degrees of rotation. In order for this design to work well, it is necessary to store sufficient energy in the flywheel within the first 150 degrees of rotation and to build up enough speed that the nail would be driven into the substrate with sufficient force to minimize the reaction on the operator. The motor used in this application is a DC motor, preferably a high power and torque design. Such a motor is commonly available from Johnson Electric North America Inc., Shelton, Conn. The power source for this tool is comprised of low impedance nickel cadmium batteries. These batteries have an internal impedance of less than 10 milliohms and preferably less than 5 milliohms. These batteries are commonly available from Sanyo North America Corporation, San Diego, Calif. Even with these parameters, this design is limited to finishing nails in the 15 to 18 gauge size.

Preferred Embodiment of the Design

Figure 2:
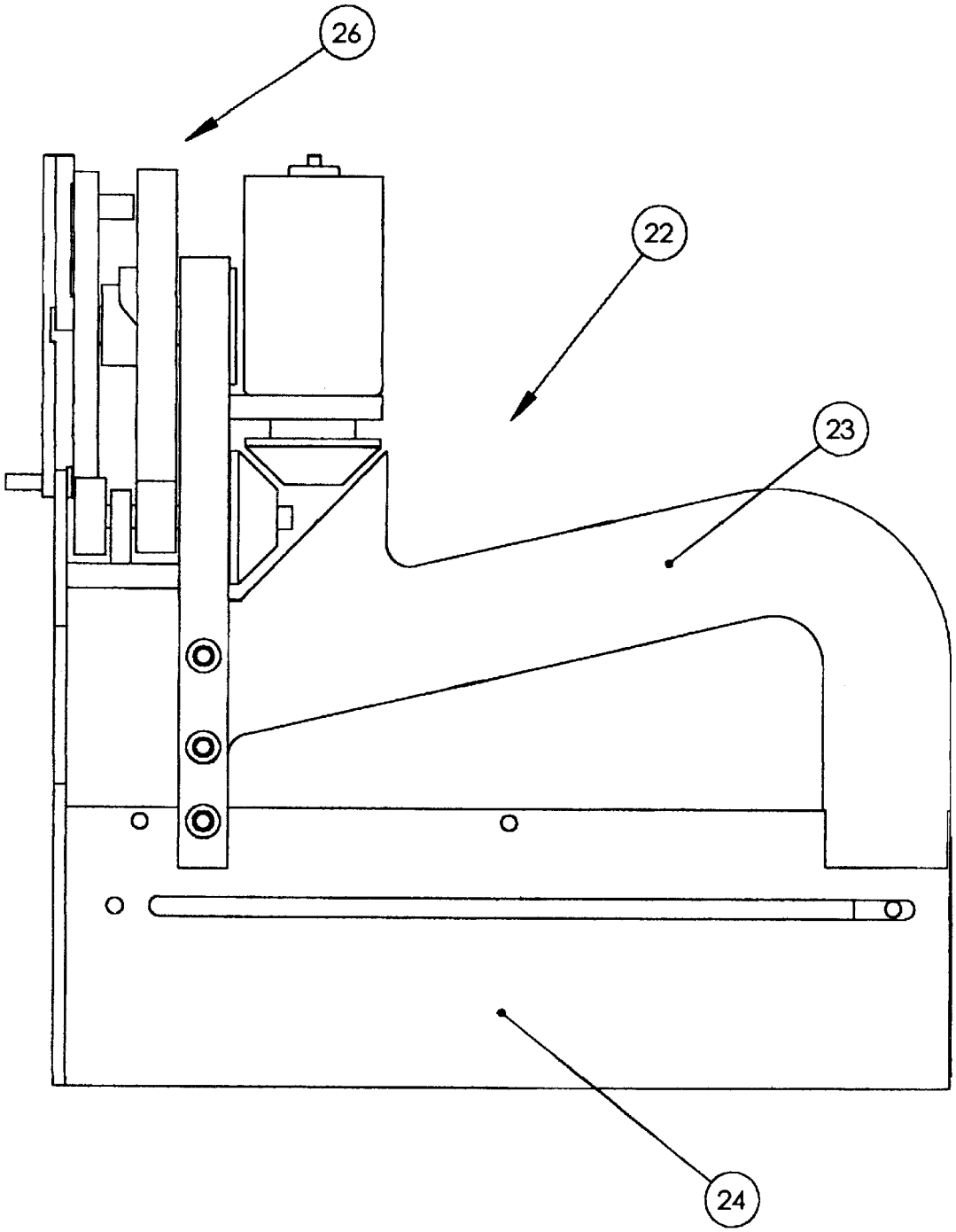
FIG. 2 is an overview of the fastener-driving tool embodying the invention.
Figure 3:
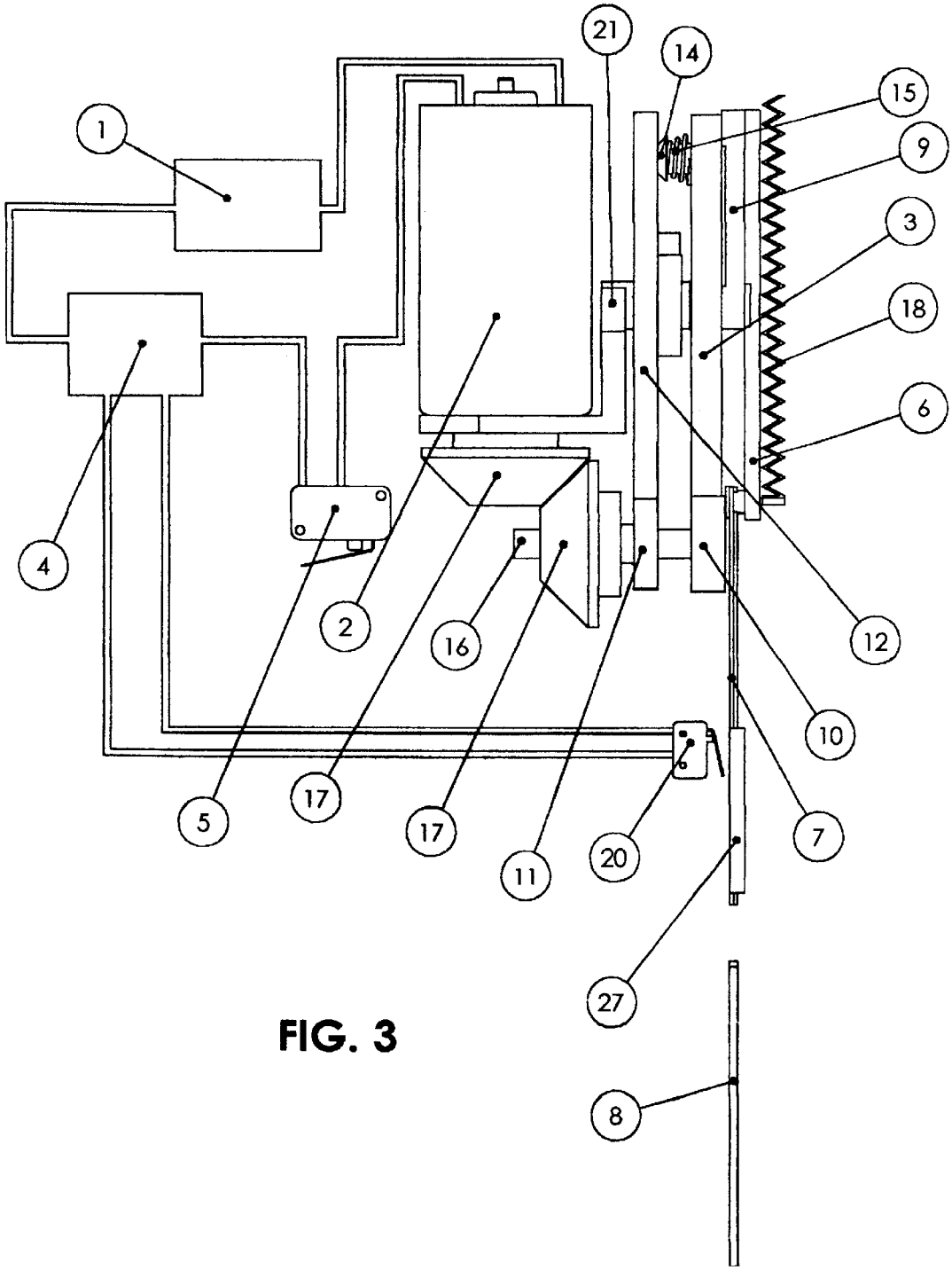
FIG. 3 is side elevation view of the fastener driving mechanism detailing the mechanism and basic electrical schematic.
Figure 4:
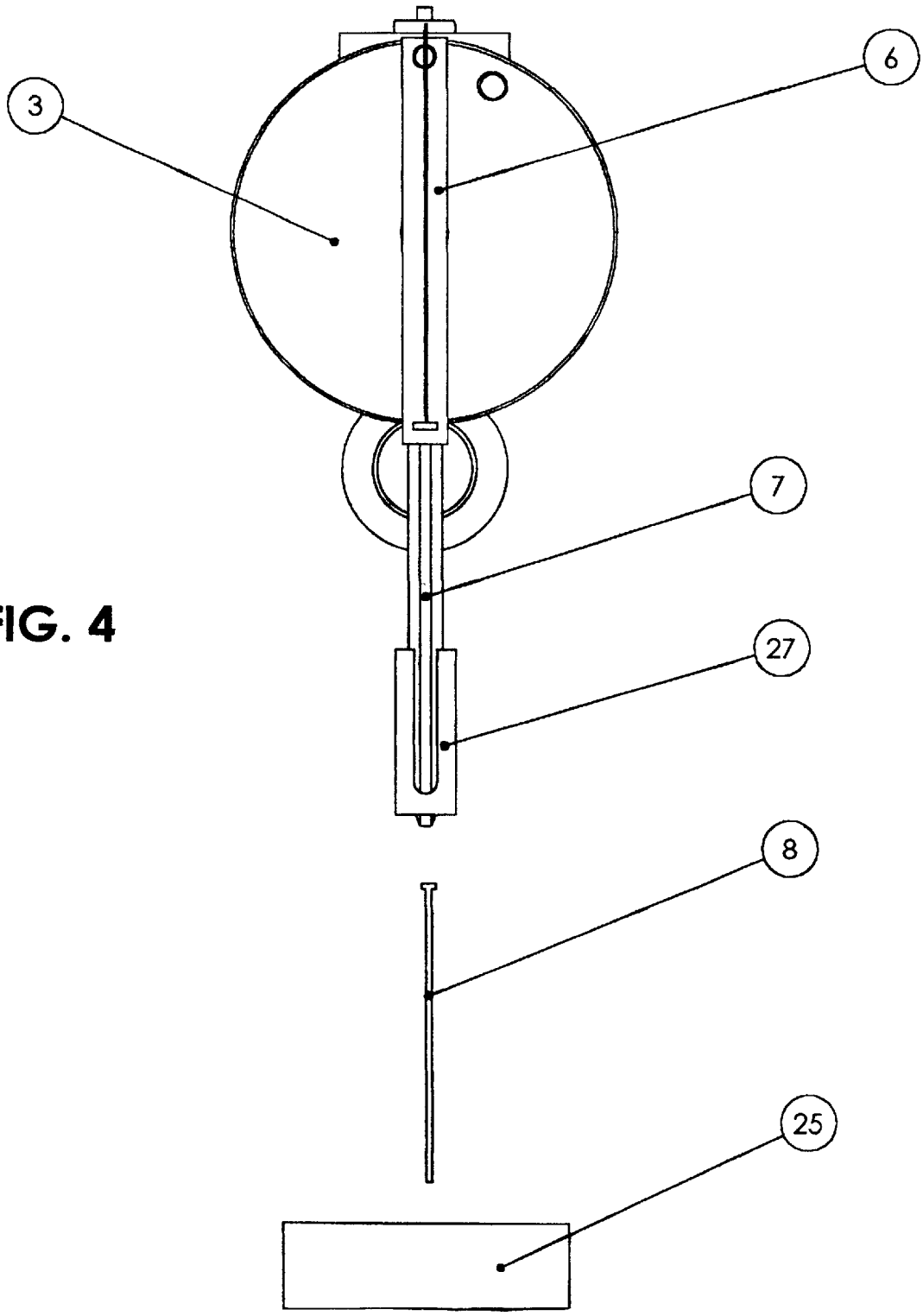
FIG. 4 is a front elevation of the tool and fastener.

FIGS. 2–5 represent a preferred embodiment of a fastener-driving tool (22) for driving fasteners such as nails (8) into substrates (25) such as wood. Referring to FIG. 2, the preferred embodiment includes a drive unit that can deliver a impact or pulse through a stroke such as, for example, a fastener driving tool (22). The fastener-driving tool (22) comprises a handle (23), a feeder mechanism (24), and the nail driving mechanism (26). The feeder mechanism is spring biased to force fasteners, such as nails or staples, serially one after the other, into position underneath the nail-driving anvil. FIGS. 3–6 detail the nail driving mechanism. Referring to FIG. 3, the motor (2) is controlled over an intermittent cycle to drive a nail (8) beginning by placing the fastener driving tool (22) against the substrates (25) which are to be fastened and actuating a switch (5). This intermittent cycle ends when the nail (8) has been driven and the nail driving mechanism (26) is reset and ready to be actuated again. This intermittent cycle can take up to 2 seconds but preferably takes less than 500 milliseconds.

Figure 5:
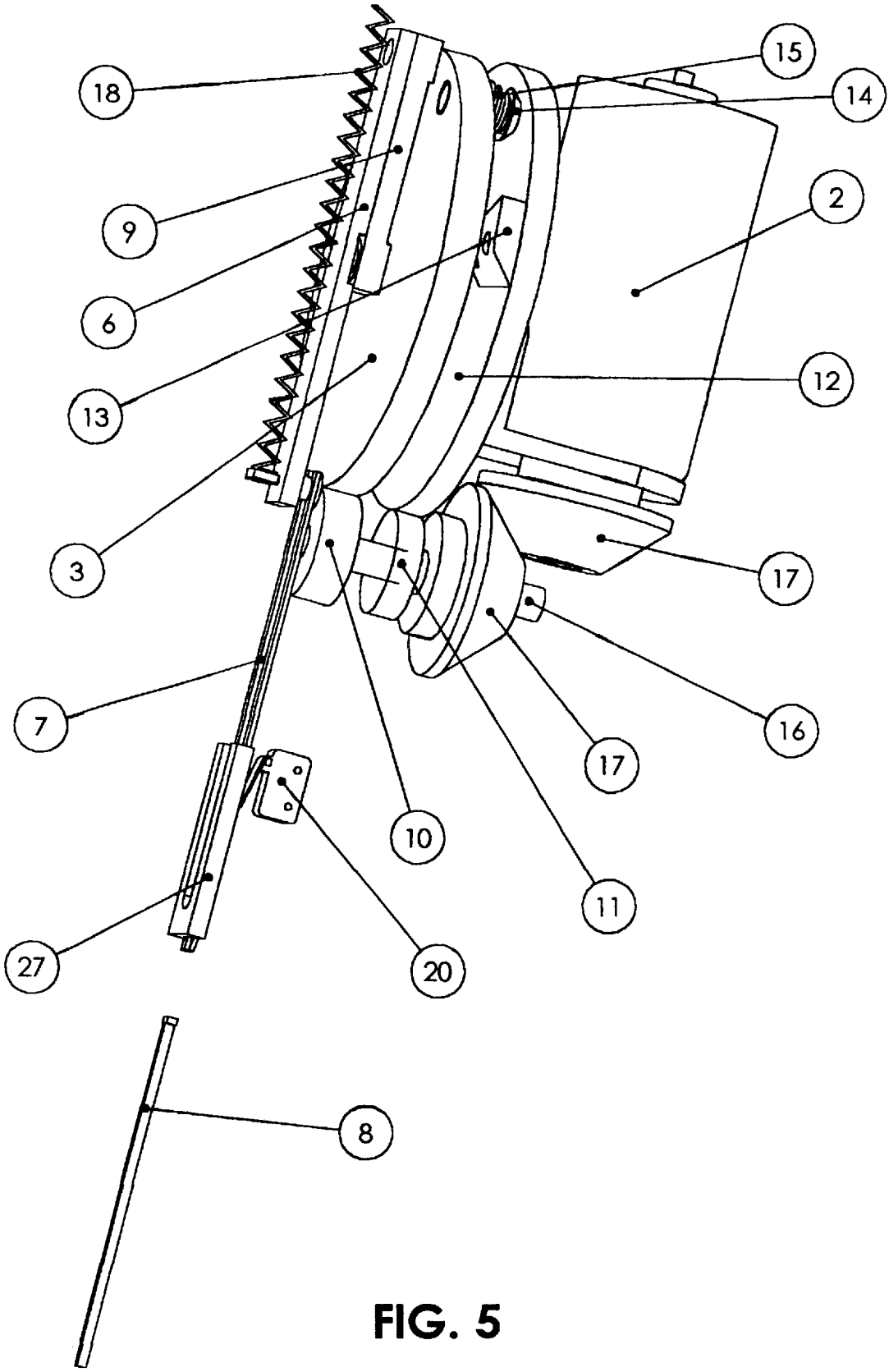
FIG. 5 is an isometric view of the device driving mechanism.

The control circuitry (4) and switch (5) apply power to the motor (2) from power source (1). The motor (2), supported by the motor mount (21), is coupled to the drive shaft (16) through the drive gears (17). The drive shaft (16) drives both the flywheel (3) and the cam gear (12) through the flywheel pinion (10) and the cam gear pinion (11) respectively. The applied power causes the flywheel (3) and the cam gear (12) to rotate. The ratio of the cam gear (12) and the cam gear pinion (11) in relation to the ratio of the flywheel pinion (10) and the flywheel (3) are not the same. The ratios can fall within a relatively wide band and for this preferred embodiment have been set at 4.33:1 and 4:1 respectively. This initiates relative motion between the cam gear (12) and the flywheel (3) i.e. the cam gear and the flywheel are rotating at different speeds. Referring now to FIG. 5, the clutch cam (13) is connected to the cam gear (12) and rotates with same. As the cam gear (12) and the flywheel (3) rotate the clutch cam (13) approaches the clutch drive pin (14). The clutch drive pin (14) is located through a hole in the flywheel (3) and is forced against the cam gear (12) by the clutch drive pin return spring (15). The gear ratio differential between the flywheel (3) and the cam gear (12) is such that after the flywheel (3) makes from 1–100 revolutions, the preferred number of revolutions being 12, the clutch cam (13) engages the clutch drive pin (14). As the clutch cam (13) initiates contact with the clutch drive pin (14), the clutch drive pin (14) compresses the clutch drive pin return spring (15) and protrudes through the face of the flywheel (3). As the flywheel (3) rotates with the clutch drive pin (14) extended, the clutch drive pin (14) engages the crank arm (9). The crank arm (9) then rotates in unison with the flywheel (3). The crank arm (9) is connected to the crank link (6) on one end and connected to the center of the flywheel (3) on the other. The crank link (6) is connected to the anvil (7) to form the slider crank mechanism. The anvil (7) slides up and down the anvil guide (27) and makes contact to drive the nail (8). Once the anvil (7) is in motion a sensor informs the control circuitry device (4) which uses this information to control motor power and braking. The motor power is then removed and the motor windings are connected together thru a low resistance connection (preferable less than 100 milli ohms). This allows for a rapid slow down of the motor (2) and flywheel (3) during the next 90 to 720 degrees. The flywheel (3) can possess varying amounts of energy depending on the length of the nail and the substrate the nail is being driven into. If the tool were to be dry cycled without engaging a nail the flywheel would possess much more energy than if the tool had just driven a 2½ inch nail into an oak substrate. By allowing several revolutions between when clutch activates the slider crank mechanism, the brake is allowed to dissipate varying amounts of energy and still allow sufficient energy input in the next drive cycle. Returning to FIG. 5, once the anvil (7) reaches past bottom dead center the clutch cam (13) has moved far enough relative to the clutch drive pin (14), the clutch drive pin return spring (15) can force the clutch drive pin (14) back against the cam gear and disengage the crank arm (9). This disengagement occurs preferably when the slider crank mechanism has nearly completed its return stroke. The anvil return spring (18) then biases the anvil (7) and the slider crank mechanism towards top dead center in readiness for the next cycle.

Circuit Description

Figure 6:
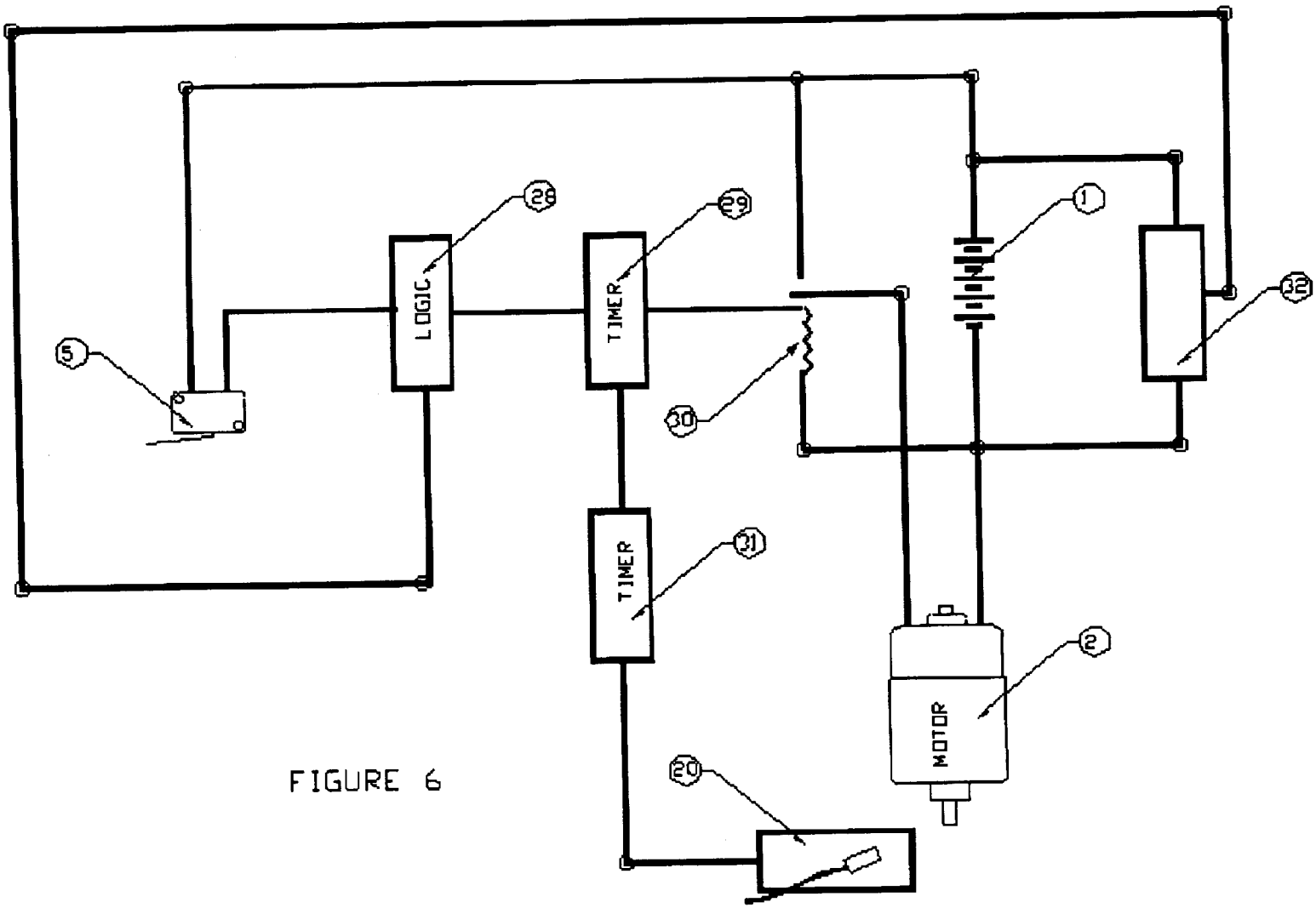
FIG. 6 is a schematic block diagram of the motor control of the invention.

The following is a description of the control circuitry device. The circuit block diagram is shown in FIG. 6. The actual design details for this circuit are familiar to an electrical engineer and could be implemented by one skilled in the art. It is important to note that the control circuitry device is defined as a means for coupling the power from the power source to the motor; and that any means for doing so may be used, including but not limited to, the use of a mechanism as simple as an on/off switch. The control circuitry device described in FIG. 6 is one embodiment of this device, but it is not the only embodiment covered by this invention.

In the circuit, the operator actuates trigger switch (5). The electrical signal from the trigger switch is sent into the safety circuit (28). The safety circuit (28) determines that all requirements for the safe actuation of the firing mechanism have been met. These include determining that the nail driving head is pressed up against the substrates and that there is not an indication from the low battery indicator circuit (32). If the safety requirements have been met, the on timer delay circuit (29) is activated. The on timer circuit (29) supplies a signal to the power switching circuit (30) for a predetermined period of time. This time can range from 50 to 700 milliseconds with the preferred timing range of 200–300 milliseconds. During this period, the power switching circuit (30) connects a low impedance power supply (1) to the motor (2) allowing it to rapidly accelerate an energy storage mechanism for later coupling and release to the fastener driving mechanism. The power switching circuit (30) consists of low impedance switches having an on resistance of less than 25 milliohms. In addition, a flywheel speed detection sensor can be used (not shown). This speed detection sensor could be used to allow an electric clutch to be engaged as a result of the flywheel energy exceeding a predetermined adjustable threshold requirement. Additionally, this speed detection scheme could be used to allow the motor to hold a constant velocity once sufficient energy for driving the fastener into the substrate has been achieved.

Once the fastener driving mechanism has been coupled to the flywheel, the anvil position pickup sensor (20) is used to detect the position of the anvil. This allows accurate timing for disconnecting the power supply (1) from the motor (2). This anvil position pickup sensor (20) can be used in conjunction with a timing circuit to allow said sensor to be located at different places on the output anvil.

After the anvil position pickup sensor (20) has determined that the fastener has been driven, it provides a signal to the off timer delay circuit (31). The off timer delay circuit (31) resets the on timer delay circuit (29) which causes the power supply (1) to be disconnected from the motor (2). The motor (2) is then connected to a brake that reduces its speed. The motor speed is reduced to less than 1000 rpm with the preferred speed being less than 10 rpm. The preferred brake is a simple dynamic brake accomplished by shunting the motor (2) through a low resistance circuit. Furthermore, the brake can also include reverse biasing the motor (2) from the power supply (1) for an even quicker stop.

The off timer delay circuit (31) is set to a time of 10–500 milliseconds, with the preferred time period of 200 milliseconds. Once the off timer delay circuit (31) times out, the circuit operation can be re-initiated by pressing the trigger switch. (5)

We claim:

1. An apparatus for driving a fastener into a material comprising:

a power source;

a motor;

means for coupling said power source to said motor for the purpose of directing power from the power source to the motor;

a kinetic energy storing mechanism;

means for coupling said motor to said kinetic energy storing mechanism to allow the motor to supply and transfer energy to said kinetic energy storing mechanism;

a clutching mechanism;

means for engaging said clutching mechanism with said kinetic energy storing mechanism;

a fastener driving device comprising a slider crank mechanism coupled to said clutching mechanism;

means for transferring energy from said kinetic energy storing mechanism to said fastener driving device;

a fastener;

means for bringing the fastener driving device into contact with said fastener to drive said fastener into a substrate material; and means for returning and biasing fastener driving device at top dead center.

2. The apparatus according to claim 1, further comprising a braking mechanism coupled to the control circuitry device and the kinetic energy storing mechanism.

3. The apparatus according to claim 1, further comprising a means for detecting the position of the fastener driving device.

4. An apparatus for driving a fastener into a material comprising:

a power source;

a motor;

means for coupling said power source to said motor for the purpose of directing power from the power source to the motor;

a kinetic energy storing mechanism;

means for coupling said motor to said kinetic energy storing mechanism to allow the motor to supply and transfer energy to said kinetic energy storing mechanism;

a clutching mechanism;

means for engaging said clutching mechanism with said kinetic energy storing mechanism;

a fastener driving device coupled to said clutching mechanism;

means for transferring energy from said kinetic energy storing mechanism to said fastener driving device;

a fastener;

means for bringing the fastener driving device into contact with said fastener to drive said fastener into a substrate material;

a means for detecting the position of the fastener driving device.

5. The apparatus according to claim 4, further comprising a braking mechanism coupled to the motor and the kinetic energy storing mechanism.

6. The apparatus according to claim 4, wherein said fastener driving device is a slider crank mechanism.

7. The apparatus according to claim 1 or 4, in which transfer of power from said power source to said motor is characterized by a resistance of less than 14 milliohms per applied volt.

8. The apparatus according to claim 7, wherein the power source is coupled with a stiffening capacitor that is in parallel with said power source, wherein said capacitor has a capacitance of at least 0.1 farads.

9. The apparatus according to claim 2 or 5, in which the braking mechanism uses a means of dynamic braking from the motor to dissipate excess energy remaining in the kinetic energy storage mechanism after the fastener has been driven.

10. The apparatus according to claim 9, wherein at least a portion of the energy removed during dynamic braking is used to recharge the power source.

11. The apparatus according to claim 1 or 4, in which the axis of the motor and the axis of the kinetic energy storage device are in parallel to minimize reaction forces on startup.

12. The apparatus according to claim 1 or 4, in which the motor is coupled to said kinetic energy storage mechanism through a reduction means of between 1.5:1 to 10:1.

13. The apparatus according to claim 1 or 4, wherein the clutching mechanism engages the kinetic energy storing mechanism after a predetermined amount of energy is stored in the kinetic energy storage mechanism.

14. The apparatus according to claim 1 or 4, wherein the clutching mechanism is a mechanical asynchronous lockup clutch which positively engages and disengages the fastener driving device.

15. The apparatus according to claim 1 or 4, wherein the motor stops adding additional energy to the kinetic energy storing mechanism after a predetermined amount of energy is stored in the kinetic energy storage mechanism.

16. The apparatus according to claim 1 or 4, wherein the clutching mechanism is an electrical lockup clutch which positively engages the fastener driving device.

17. The apparatus according to claim 2 or 5, wherein the braking mechanism reduces the energy in the kinetic energy storage device to less than 5 ft-lbs.

18. The apparatus according to claim 2 or 5, further comprising a cycle time for storing energy in the kinetic energy storing mechanism, driving the fastener and braking the excess energy through the braking mechanism, and wherein said cycle time is less than 2 seconds.

19. The apparatus according to claim 18, further comprising a timer and a low power source indicator, wherein said timer measures the cycle time and low power source indicator is activated if said cycle time is not less than 2 seconds.

20. The apparatus according to claim 19, wherein the low power source indicator can only be reset by physically removing and replacing said power source.

21. The apparatus according to claim 3 or 4, wherein the clutching mechanism is controlled in response to the means for detecting the position of the fastener driving device.

22. The apparatus according to claim 3 or 5, wherein the braking mechanism is controlled in response to the means for detecting the position of the fastener driving device.

23. The apparatus according to claim 1 or 4, wherein said power source is coupled to said motor through low impedance switches having a resistance of less than 25 milliohms.

24. An apparatus for driving a fastener into a material comprising:

a power source;

a motor;

means for coupling said power source to said motor for the purpose of directing power from the power source to the motor;

a kinetic energy storing mechanism;

means for coupling said motor to said kinetic energy storing mechanism to allow the motor to supply energy to said kinetic energy storing mechanism;

a mechanical asynchronous lockup clutching mechanism coupled to said kinetic energy storing mechanism;

means for engaging said mechanical asynchronous lockup clutching mechanism with said kinetic energy storing mechanism;

a fastener driving device coupled to said mechanical asynchronous lockup clutching mechanism;

means for transferring energy from said kinetic energy storing mechanism to said fastener driving device;

a fastener;

means for bringing the fastener driving device into contact with said fastener to drive said fastener into a substrate material.

25. The apparatus according to claim 24, wherein the mechanical asynchronous lockup clutching mechanism engages between 10 to 300 revolutions of the motor.

* * * * *